US010793992B2

(12) United States Patent
Choi et al.

(10) Patent No.: US 10,793,992 B2
(45) Date of Patent: Oct. 6, 2020

(54) DRAIN PUMP

(71) Applicant: LG ELECTRONICS INC., Seoul (KR)

(72) Inventors: Hoon Choi, Seoul (KR); Donggi Shin, Seoul (KR); Gunho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 160 days.

(21) Appl. No.: 15/699,299

(22) Filed: Sep. 8, 2017

(65) Prior Publication Data

US 2018/0073186 A1 Mar. 15, 2018

(30) Foreign Application Priority Data

Sep. 13, 2016 (KR) ..... 10-2016-0118284

(51) Int. Cl.
*D06F 39/08* (2006.01)
*D06F 33/00* (2020.01)
(Continued)

(52) U.S. Cl.
CPC ..... *D06F 39/085* (2013.01); *D06F 25/00* (2013.01); *D06F 33/00* (2013.01); *D06F 37/20* (2013.01);
(Continued)

(58) Field of Classification Search
CPC .... F04D 29/247; F04D 29/22; F04D 29/2211; F04D 29/2205; A47L 15/0021;
(Continued)

(56) References Cited

U.S. PATENT DOCUMENTS 2,853,127 A * 9/1958 Sessen ..... C08C 1/12 159/47.1
5,771,719 A * 6/1998 Moon ..... D06F 17/06 68/183

(Continued)

FOREIGN PATENT DOCUMENTS

DE 10 2014 222 050 3/2016
EP 0 833 003 4/1998

(Continued)

OTHER PUBLICATIONS

FLORJANCIC Jan. 24, 1991 JP,03015695,A machine translation (Year: 1991).*

(Continued)

*Primary Examiner* — Carl C Staubach
(74) *Attorney, Agent, or Firm* — Ked & Associates, LLP

(57) ABSTRACT

The present disclosure relates to a drain pump for a laundry treating apparatus, including a housing configured to accommodate water; a water flow portion provided with an impeller forming a flow of water or wash water, and formed on an inner circumferential surface of the housing to circulate the accommodated water or wash water to a tub or drain the accommodated water or wash water out of a washing machine; a drain pump chamber formed on an inner circumferential surface of the housing to receive or store the water or wash water before the water or wash water flows into the water flow portion; and an inlet port formed to protrude toward the water flow portion between the water flow portion and the drain pump chamber.

20 Claims, 10 Drawing Sheets

(51) Int. Cl.

| | |
|---|---|
| ***D06F 25/00*** | (2006.01) |
| ***D06F 37/20*** | (2006.01) |
| ***F04D 29/18*** | (2006.01) |
| ***F04D 29/42*** | (2006.01) |

(52) U.S. Cl.
CPC ..... *F04D 29/18* (2013.01); *F04D 29/4293* (2013.01)

(58) Field of Classification Search
CPC ..... A47L 15/4217; A47L 15/4221; A47L 15/4223; A47L 15/4225; A47L 2501/03; D06F 39/085; D06F 17/06; Y10S 415/911
See application file for complete search history.

(56) References Cited

U.S. PATENT DOCUMENTS

| | | | | |
|---|---|---|---|---|
| 6,189,551 | B1 | 2/2001 | Sargeant et al. | |
| 8,926,275 | B2 * | 1/2015 | Badafem | F04D 29/426 415/126 |
| 2005/0175455 | A1 * | 8/2005 | Favret | D06F 39/085 416/106 |
| 2012/0224961 | A1 * | 9/2012 | Weber | F04D 9/003 415/220 |
| 2014/0072414 | A1 | 3/2014 | Koegel et al. | |
| 2017/0356120 | A1 * | 12/2017 | Choi | D06F 39/085 |

FOREIGN PATENT DOCUMENTS

| | | | | |
|---|---|---|---|---|
| EP | 1887126 | 2/2008 | | |
| EP | 2495444 | 9/2012 | | |
| EP | 2 708 754 | 3/2014 | | |
| JP | 03015695 A | * 1/1991 | | F01D 5/041 |
| JP | 2007-143735 | 6/2007 | | |
| KR | 2000-0070638 | 11/2000 | | |
| KR | 2013-0109354 | 10/2013 | | |
| KR | 10-1626896 | 6/2016 | | |
| WO | WO 03/072947 | 9/2003 | | |

OTHER PUBLICATIONS

Korean Office Action issued in Application 10-2016-0118284 dated Jul. 31, 2017 (full Korean text).
Extended European Search Report issued in Application 17190172.1 dated Dec. 21, 2017.
PCT Search Report issued in Application PCT / KR2017/ 008982 dated Dec. 7, 2017 (full Korean text).

* cited by examiner

DRAIN PUMP

CROSS-REFERENCE TO RELATED APPLICATION

This application claims priority under 35 U.S.C. § 119 to Korean Application No. 10-2016-0118284 filed on Sep. 13, 2016, whose entire disclosure is hereby incorporated by reference.

BACKGROUND

1. Field

The present disclosure relates to a drain pump. In particular, the present disclosure relates to a drain pump provided in a laundry treating apparatus, and more particularly, to a drain pump for a laundry treating apparatus for draining or circulating water or wash water flowing from a drum.

2. Background

The laundry treating apparatus is a device for putting clothing, bedding or the like (hereinafter, referred to as laundry) into the drum to remove contamination from the laundry, and performs the processes of washing, rinsing, dehydrating, drying and the like.

The laundry treating apparatus is divided into a top-loading type and a front-loading type based on a method of putting laundry into a drum. The front-loading type washing machine is generally called a drum washing machine.

FIG. 1 illustrates an appearance of a drum washing machine, and FIG. 2 illustrates an internal appearance of the drum washing machine of FIG. 1.

The laundry treating apparatus includes a laundry treating apparatus cabinet 11 forming an outer appearance, a drum 21 rotatably mounted in the cabinet 11 to put laundry thereinto, a lifter (not shown) provided within the drum 21, and a door 12 provided on a front surface of the cabinet 11. A detergent inlet cover 13 for covering a detergent inlet for putting detergent thereinto is disposed at a lower portion of the cabinet 11. In addition, the laundry treating apparatus includes a duct 15 and a heat exchanger 20 since air must be circulated to dry laundry accommodated in the drum 21.

For a front-loading type laundry treating apparatus, namely, a drum washing machine 10, when laundry is accommodated into the drum and water is supplied, a washing process is performed through the rotation of the drum 21, and the laundry treating apparatus undergoes processes such as rinsing, dehydrating, and the like, and then undergoes a process of discharging water or wash water to the outside. The drum washing machine 10 includes a circulation pump for circulating water in the drum 21 during the washing process and a drain pump for discharging water or wash water generated through the washing process to the outside.

In the related art, pumps for circulating and draining water or wash water in a drum washing machine have been generally configured through separate motors, respectively. In this case, there is a restriction in the installation space, and a plurality of motors are required, which is not cost effective.

In order to improve this, one motor and an impeller have been used to convert a rotational direction of the impeller to serve as a circulation pump and a drain pump, but when they are configured to allow drainage and circulation using a method of switching a flow direction of water or wash water, there is a problem that water or wash water flows backward toward an undesired flow path in the circulation process or drainage process.

Accordingly, there is a need for an apparatus configured to perform both functions of the drain pump and the circulation pump, respectively, using one motor and an impeller so as to limit water or wash water flowing in the drainage process or circulation process from flowing back through an undesired flow path while not limiting an internal installation space of the laundry treating apparatus.

On the other hand, if a water or wash water inflow pressure in the drain pump is excessively reduced to prevent a backflow of the drain pump, a cavitation phenomenon occurs in the drain pump, thereby increasing noise during the operation of the drain pump.

As a result, there is a need for an apparatus capable of preventing a cavitation phenomenon as well as a backflow phenomenon in a drain pump having one motor and an impeller.

BRIEF DESCRIPTION OF THE DRAWINGS

Embodiments will be described in detail with reference to the following drawings in which like reference numerals refer to like elements and wherein.

DETAILED DESCRIPTION

Figure 1:
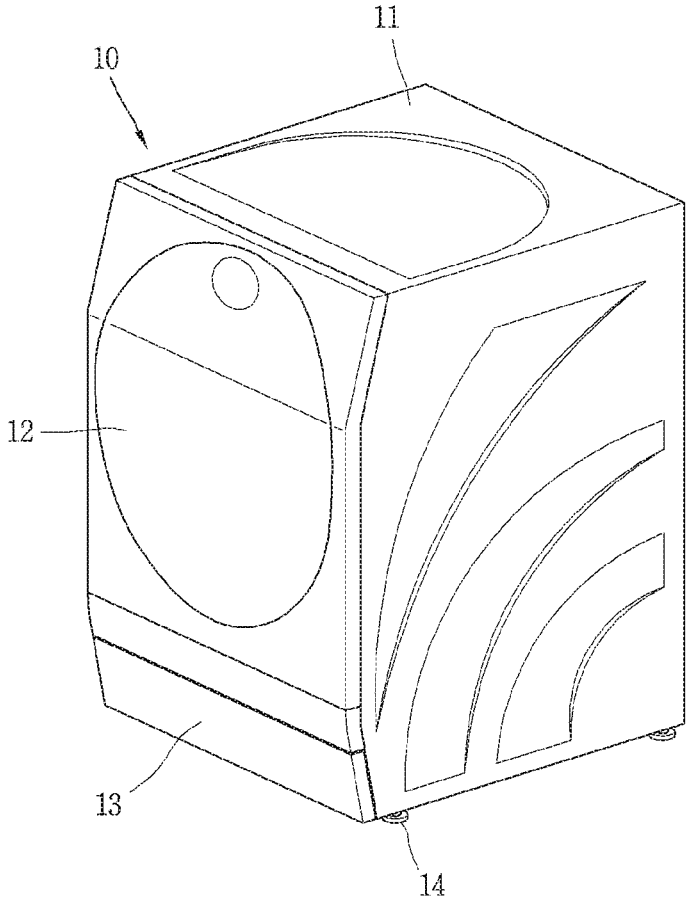
FIG. 1 is a perspective view illustrating an outer appearance of a laundry treating apparatus.

Hereinafter, a drain pump for a laundry treating apparatus associated with the present disclosure will be described in detail with reference to the drawings.

Even in different embodiments according to the present disclosure, the same or similar reference numerals are designated to the same or similar configurations, and the description thereof will be substituted by the earlier description. Unless clearly used otherwise, expressions in the singular number used in the present disclosure may include a plural meaning.

Furthermore, in the following description, a drain pump applied to the laundry treating apparatus has been described, but application examples of a drain pump according to the present disclosure will not be limited to the laundry treating apparatus.

In other words, a drain pump according to the present disclosure may include a plurality of discharge ports, and may be applied to various products in order to perform the purpose of discharging water to one of the plurality of discharge ports using a single motor.

FIG. 1 is a view illustrating an outer appearance of the laundry treating apparatus 10.

The laundry treating apparatus 10 includes a laundry treating apparatus cabinet 11 forming an outer appearance, a drum 21 rotatably mounted in the cabinet 11 to put laundry thereinto, a lifter (not shown) provided within the drum 21, and a door 12 provided on a front surface of the cabinet 11. In addition, a detergent inlet cover 13 for covering the detergent inlet is positioned below the cabinet 11. Moreover, the laundry treating apparatus 10 includes a duct 15 and a heat exchanger (not shown) since air must be circulated to dry laundry accommodated in the drum 21.

A storage container (not shown) capable of accommodating detergent and fabric softener and being drawn out of the cabinet 11, a plurality of elastic members and a damper (not shown) configured to support the drum 21 to suppress vibration, and a driving motor (not shown) configured to rotate the drum 21 may be provided at a lower portion of the laundry treating apparatus 10. Furthermore, the door 12 may be provided on a front surface of the cabinet 11 so that laundry to be washed can be taken in and out. The door 12 may be configured to open and close a front surface of the drum 21. The door 12 may have a disk shape. An electric heater (not shown) capable of heating water when power is applied may be provided at a lower portion of the drum 21.

A drain pump for draining water or wash water inside the drum 21 may be provided at a lower side of the drum 21. Furthermore, a circulation pump (not shown) is provided at a lower side of the drum 21 to draw water out of the drum 21 so as to flow into an upper region of the drum 21. A filter unit (not shown) may be provided at one side of the drain pump 100 to collect foreign substances in water drawn out of the drum 21. A plurality of legs 14 spaced apart from the ground by a predetermined height to support the laundry treating apparatus are disposed at a lower portion of the laundry treating apparatus 10.

Figure 2:
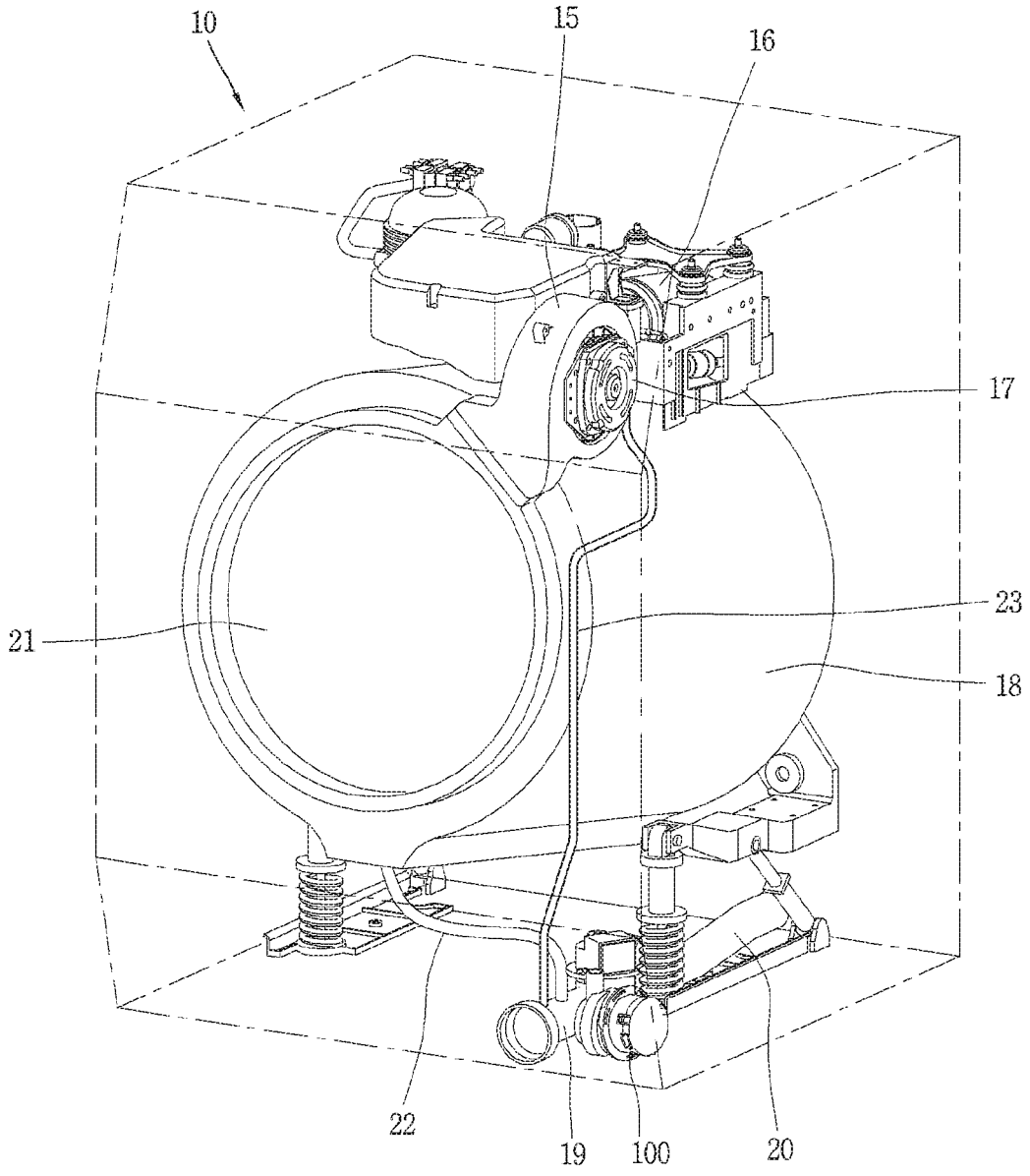
FIG. 2 is a perspective view illustrating an inner appearance of a laundry treating apparatus including a drain pump.

FIG. 2 is a view illustrating an inner appearance of the laundry treating apparatus 10 including the drain pump 100.

The laundry treating apparatus 10 includes a cabinet 11 for forming an outer appearance, a tub 18 accommodated in the cabinet 11, and a drum 21 rotatably mounted inside the tub 18 to put laundry thereinto. Furthermore, since air must be circulated in order to dry laundry in the drum 21, the laundry treating apparatus 10 includes a duct 15, a heat exchanger, and a fan motor 17, and includes a compressor 16 and a compressor support (not shown) for supporting the compressor. In addition, the laundry treating apparatus 10 includes a condensate discharge pipe 23 for discharging condensate generated from air passing through a heat exchanger (not shown) to the outside as the air is circulated, a drain pump chamber 19, a drain pump 100, a drain hose 20, and a drain connection pipe (not shown).

The drain pump 100 according to the present disclosure is positioned at a lower portion of the laundry treating apparatus 10. When water or wash water in the tub 19 moves to the drain pump chamber 19 and flows into the housing 110 of the drain pump 100, the drain pump 100 may perform a circulation process of moving the water or wash water through the circulation port 111 by the driving of the motor to move the water or wash water toward the tub or perform a drainage process of moving the inflow water or wash water toward the drain port 112 to discharge the water or wash water to the outside.

Figure 3:
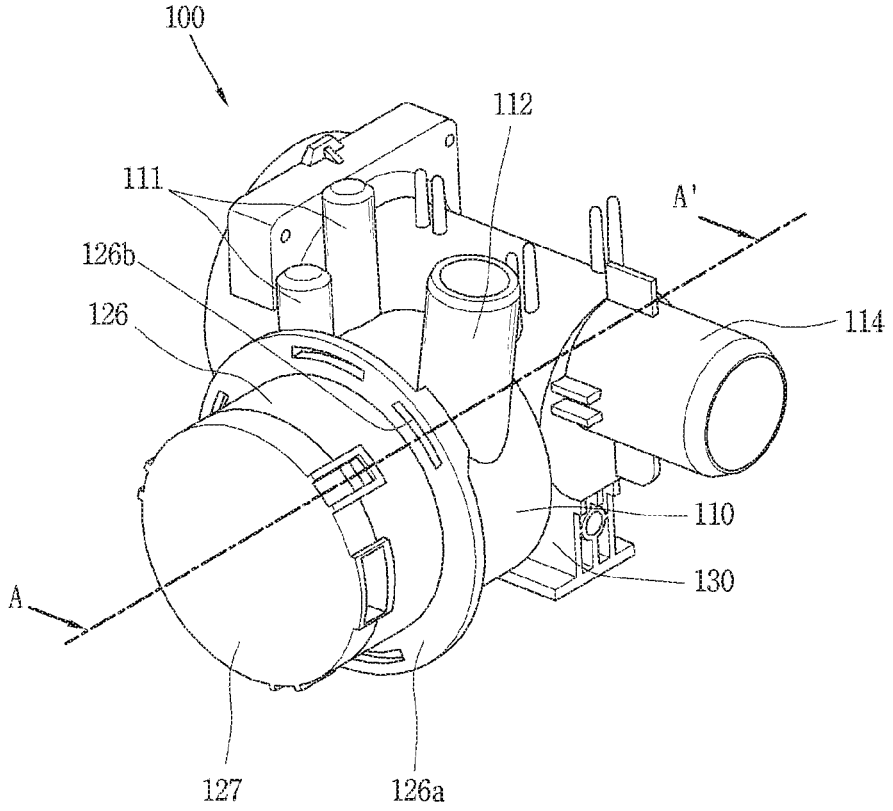
FIG. 3 is a view illustrating an outer appearance of a drain pump for a laundry treating apparatus.
Figure 4:
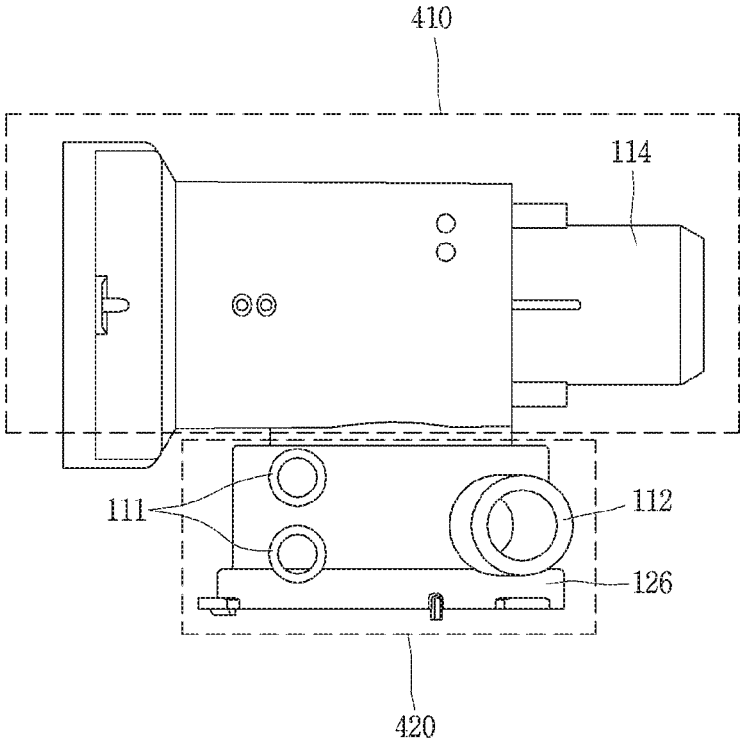
FIG. 4 is a plan view in which the drain pump for a laundry treating apparatus in FIG. 3 is seen from above.

FIG. 3 is a view illustrating an outer appearance of the drain pump 100 for a laundry treating apparatus, and FIG. 4 is a view in which the drain pump 100 for a laundry treating apparatus in FIG. 3 is seen from above.

The drain pump 100 for a laundry treating apparatus according to the present disclosure includes a housing 110 configured to form an outer appearance thereof, an impeller 125 configured to form a flow of water or wash water rotated and accommodated inside the housing 110, and a motor (not shown) configured to provide power for rotating the motor.

Specifically, the housing 110 may be divided into a water flow portion 420 and a drain pump chamber 410. The housing 110 may accommodate water.

The drain pump chamber 410 may be formed on an inner circumferential surface of the housing 110 to receive or store water or wash water before the water or wash water flows into the water flowing unit 420.

The drain pump room 410 may receive contaminated water or wash water from the tub or receive clean water or wash water from the outside. Both ends of the drain pump chamber 410 may receive contaminated wash water or clean wash water, respectively.

The water flow portion 420 may be formed on an inner circumferential surface of the housing 110 to circulate water or wash water introduced from the drain pump chamber 410 to the tub or drain the water or wash water out of the washing machine so as to form a flow of the introduced water or wash water.

In other words, an impeller 125 rotating in an arbitrary direction by a motor is provided inside the water flow portion 420. The flow of water or wash water may be determined within the water flow portion 420 according to the rotational direction of the impeller 125.

According to one embodiment, the housing 110 may include a first discharge port and a second discharge port spaced apart from one another to form a moving path of the accommodated water. The water flow portion 420 may include an impeller formed on an inner circumferential surface of the housing 110 to form a flow of water so that the water accommodated in the housing 110 is discharged through the first discharge port or discharged through the second discharge port.

The drain pump chamber 410 may be provided on an inner circumferential surface of the housing 110 to receive or store water before the water flows into the water flow portion 420.

The drain pump 100 for a laundry treating apparatus according to the present disclosure may perform the functions of a drain pump and a circulation pump, respectively, since the rotational direction of the motor is switchable differently from a drain pump in the related art. In addition, since a rotational speed of the motor is controllable, it may be possible to operate at a high speed in the drainage process and operate at a relatively low speed in the circulation process as compared with the drainage process, thereby preventing unnecessary noise and power consumption.

In other words, the drain pump 100 for a laundry treating apparatus according to the present disclosure may move water or wash water introduced from the drain pump 100 through the drain port 112 or the circulation port 111, thereby performing both the functions of the drain pump and the circulation pump.

The housing 110 may form an outer appearance of the drain pump 100 having a cylindrical shape, and thus a water inlet 114 may be formed at one end of the housing 110 so that water or wash water can be introduced into the housing 110. A filter (not shown) may be installed on one side of both ends of the water inlet 114 so as to filter foreign substances in the water or wash water, and then to move through the drain pump 100.

The water or wash water generated in the washing or drainage process flows into the housing 110 through the inlet port 113 formed on the housing 110 of the drain pump 100. The water or wash water contained in the housing 110 may be discharged to the outside through the drain port 112 or the circulation port 111 by the rotating impeller 125, and therefore, the water or wash water may continuously flow into the housing 110.

As illustrated in FIG. 3, an impeller case 126 for fixing the motor (not shown) and the impeller 125 is installed at the other end of the drain pump 100. The impeller case 126 is fixedly coupled to one end of the housing 110 of the drain pump 100. The impeller case 126 serves to fix the motor (not shown) and the impeller 125. The impeller 125 is connected to a rotation shaft of the motor (not shown) and receives a rotational force from a motor (not shown) to rotate inside the drain pump 100.

A flange portion 126*a* formed to protrude outward is formed on an outer circumferential surface of the impeller case 126. The flange portion 126*a* of the impeller case 126 is formed with a protrusion accommodation portion 126*b* so as to be fitted and fixed to one end of the drain pump 100. A protrusion portion 119 protruded from an outer circumferential surface of the housing 110 is fitted and fixed to the protrusion accommodation portion 126*b*. The protrusion accommodation portion 126*b* may be formed on an outer circumferential surface of the impeller case 126, and a plurality of the protrusion accommodation portions 126*b* may be formed along the outer circumferential surface of the impeller case 126 at regular intervals.

As illustrated in FIG. 3, the impeller case 126 may further include a circular impeller case cover 127 to limit the external exposures of the impeller 125 and the motor (not shown).

The protrusion portion 119 of the housing 110 may be fitted and fixed to the protrusion accommodation portion 126*b* of the impeller case 126, and thus the impeller 125 may rotate within the housing 110 in a state where the impeller case 126 is fixed to the housing 110.

The protrusion portion 119 may be formed on an outer circumferential surface of the housing 110. The protrusion portion 119 is formed to protrude outward from an outer circumferential surface of the housing 110. The protruding portions 119 may be formed at regular intervals along an outer circumferential surface thereof to correspond to the protrusion accommodation portions 126*b* of the impeller case 126.

The protruding portion 119 may be inserted into the protrusion accommodation portion 126*b* formed on the flange portion 126*a* of the impeller case 126, and then rotated and fitted therein so that the impeller case 126 can be fixed to the housing 110.

A first discharge port 111 and a second discharge port 112 formed to protrude from the housing 110 and spaced apart from each other to form a moving path of the accommodated water may be provided on an outer circumferential surface of the housing 11. In other words, the first discharge port 111 may correspond to a circulation port, and the second discharge port 112 may correspond to a drain port.

The drain port 112 and the circulation port 111 may be respectively formed on an outer circumferential surface of the housing 110. The drain port 112 is configured to communicate with an inside of the housing 110 and protrude in a tangential direction on an outer circumferential surface of the housing 110. When the drainage process is performed, the drain port 112 serves as a moving path for moving water or wash water accommodated therein by the rotation of the impeller 125 in one direction.

The circulation port 111 is configured to communicate with an inside of the housing 110 and protrude in a tangential direction on an outer circumferential surface of the housing 110. When the laundry treating apparatus performs a circulation process, the circulation port 111 serves as a moving path for moving water or wash water accommodated therein by the rotation of the impeller 125 in one direction.

In other words, the drain port 112 and the circulation port 111 are formed on an outer circumferential surface of the housing 110, and hoses are connected to the drain port 112 and the circulation port 111, respectively, to serve as a moving path for moving water or wash water in the drainage process and the circulation process. The drain port 112 and the circulation port 111 are formed at different positions.

As illustrated in FIG. 3, the circulation port 111 may protrude upward in a tangential direction on an outer circumferential surface of the housing 110. The circulation port 111 may be formed in an oblique direction or a vertical direction. Furthermore, a plurality of circulation ports 111 may be provided thereon, and a diameter of the circulation port 111 may be determined in consideration of a size of the product and an amount of water or wash water to be circulated.

For example, two circulation ports 111 may be formed on an outer circumferential surface of the housing 110 so as to be spaced apart from each other. Here, the diameters of the two circulation ports 111 may be the same or different from each other, and outwardly protruded lengths thereof may be the same or different.

The drain port 112 may protrude upward in a tangential direction on an outer circumferential surface of the housing 110. The drain port 112 may be formed in an oblique direction or a vertical direction. The drain port 112 may be formed at a position different from the circulation port 111, and formed at a position symmetrical to a position at which the circulation port 111 is formed on the basis of an imaginary line passing through the center of the housing 110. When the drain port 112 formed on the housing 110 is only one, a diameter of the drain port 112 may be formed to be larger than that of the circulation port 111.

Figure 5A:
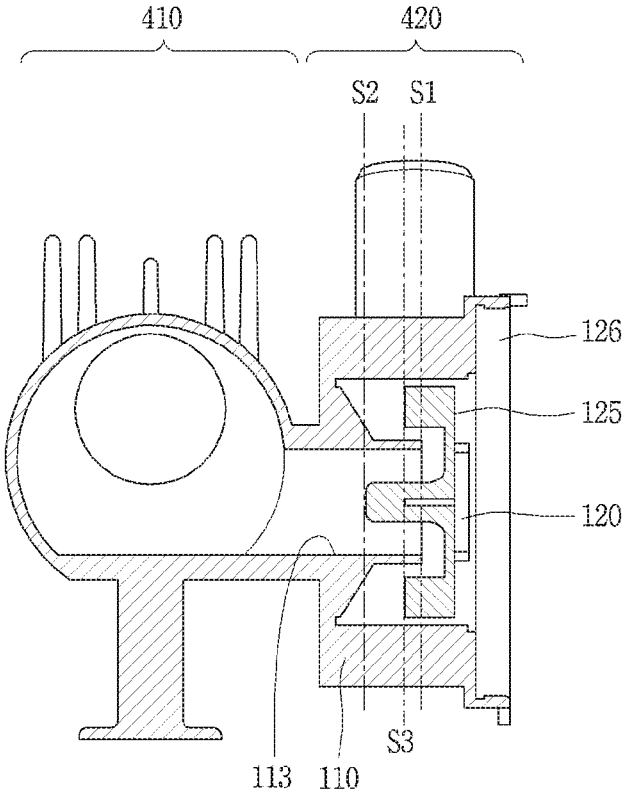
FIG. 5A is a cross-sectional view in which the drain pump in FIG. 3 is taken along line A-A'.

FIG. 5A is a cross-sectional view in which the drain pump 100 in FIG. 3 is taken along line A-A'. Specifically, a drain pump chamber 410 is shown on the left side of FIG. 5A, and a water flow portion 420 is shown on the right side.

Referring to FIG. 5A, the inlet port 113 may be provided between the drain pump chamber 410 and the water flow portion 420 within the housing 110.

Specifically, the inlet port 113 may be formed to protrude toward the water flow portion 420. Here, the impeller 125 provided in the water flow portion 420 may be formed to face the inlet port 113.

As illustrated in FIG. 5A, a protruded end of the inlet port 113 may be surrounded by a portion of the impeller 125. For example, a portion of the impeller 125 may be a blade.

In addition, another portion of the impeller 125 may be present inside the inlet port 113. In other words, a boss of the impeller 125 may be inserted into the inlet port 113.

Furthermore, a thickness of the inlet port 113 on a side of the drain pump chamber 410 may be formed to be larger than the thickness of the inlet port 113 on the side of the water flow portion 420.

As illustrated in FIG. 5A, a portion on an outer surface of the inlet port 113 may form an inclined surface. A thickness of the inlet port 113 may be formed to be thicker at a point closer to the drain pump chamber 410 due to the inclined surface.

In the water flow portion 420, the impeller case 126 for fixing the impeller 125 is fixed to one end of the housing 110. The water inlet 114 may be formed at one end of the drain pump chamber 410 to allow water or wash water to flow into an inside of the housing 110.

A motor may be positioned at one side within the housing 110, and the rotational direction and speed of the motor may be controlled by the controller. The controller (not shown) controls the rotation direction and speed of the motor according to the drainage process or the washing process using a method of transmitting a signal to the motor.

The motor according to the present disclosure may be configured with a BLDC (Brush Less Direct Current) motor so that the direction and speed of rotation can be controlled. BLCD motors are widely used in consumer and industrial applications, and have characteristics capable of miniaturization, low power consumption and low noise generation.

Unlike DC motors, BLDC motors have no brushes and their life span is semi-permanent, and controlled by semiconductor devices, thereby easily controlling their current and allowing accurate speed control. In addition, the BLDC motors have characteristics capable of rotating at high speed due to high torque.

The impeller 125 is coupled to the rotating shaft of the motor to enable the rotation of the impeller 125. The rotational direction of the impeller 125 is determined according to the rotational direction of the motor. In addition, the rotational speed of the motor may be adjusted by the controller (not shown).

According to the present disclosure, the rotational speed of the motor is driven at about 3500 rpm in the drainage process, and driven about 2500 rpm in the circulation process. The rotational directions of the motor in the drainage process and the circulation process are set to be different from each other. In general, an amount of drainage in the drainage process may be larger than an amount of water or wash water in the circulation process, and thus the rotational speed of the motor in the drainage process may be preferably larger than that of the motor in the circulation process. However, it may be set differently according to the user's setting.

Referring to FIG. 5A, the inlet port 113 may be protruded toward the water flow portion 420 or the impeller 125 such that a portion of the impeller 125 is positioned inside the inlet port 113. For example, a portion of the impeller 125 may correspond to a boss portion (hereinafter, refer to FIG. 5B) connecting the body of the impeller 125 to the shaft 120.

Furthermore, referring to FIG. 5A, the inlet port 113 may be protruded toward the water flow portion 420 so that one end of the inlet port 113 is positioned between a boss portion and a blade portion of the impeller 125.

Figure 5B:
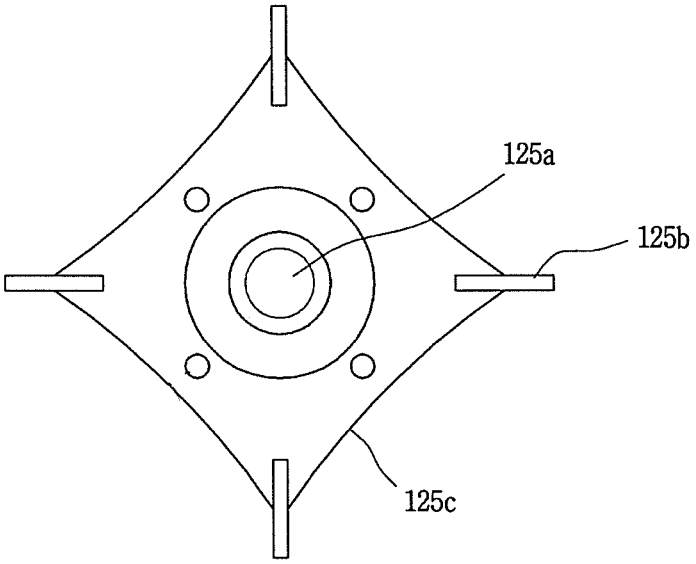
FIG. 5B is a plan view illustrating an embodiment of an impeller provided in the drain pump of the present disclosure.
Figure 5C:
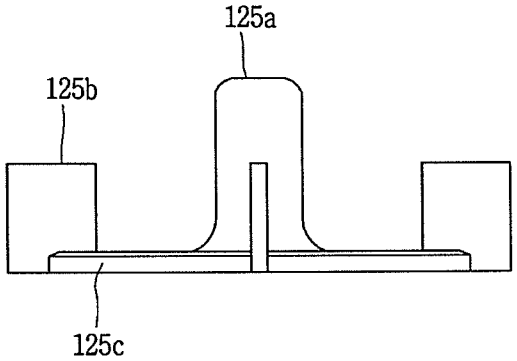
FIG. 5C is a front view illustrating an embodiment of an impeller provided in the drain pump of the present disclosure.

On the other hand, referring to FIGS. 5B and 5C, an embodiment of the impeller 125 according to the present disclosure will be illustrated.

Referring to FIG. 5B, the impeller 125 may include at least one of a boss portion 125*a*, a blade portion 125*b*, and a flange portion 125*c*.

Specifically, the boss portion 125*a* may be coupled to the rotation axis of the motor that provides a driving force for rotating the impeller 125.

The blade portion 125*b* may be formed apart from the boss portion 125*a*. In other words, the blade portion 125*b* and the boss portion 125*a* may not be directly connected. As a result, a space having a predetermined volume may be formed between the boss portion 125*a* and the blade portion 125*b*. In one example, the blade portion 125*b* may be formed in a rectangular parallelepiped shape.

Furthermore, the blade portion 125*b* may be formed to protrude out of the flange portion 125*c* in a radial direction of the flange portion 125*c*.

The impeller 125 may have a plurality of blade portions 125*b*, and the plurality of blade portions 125*b* may be disposed radially from the boss portion 125*a*.

The flange portion 125*c* may be formed with a plate connecting between the boss portion 125*a* and the blade portion 125*b*.

As illustrated in FIGS. 5A through 5C, a diameter of the boss portion 125*a* of the impeller 125 may be formed to be smaller than that of the inlet port 113. As a result, even if the inlet port 113 protrudes toward the water flow portion 420, the inlet port 113 may not be completely blocked, and water or wash water may flow into the water flow portion 420 from the drain pump chamber 410 between an inner circumferential surface of the inlet port 113 and an outer surface of the boss 125*a*.

Referring to FIG. 5A, a first surface (S1) formed by one end of the inlet port 113 may be formed to be closer to the flange portion 125*c* than a second surface (S2) formed by one end of the boss portion 125*b* on the side of the drain pump chamber 410. Accordingly, a portion of the boss portion 125*b* may be positioned within the inlet port 113.

In one embodiment, a diameter of the boss portion 125*b* may be formed with a minimum length for coupling with the shaft 120 to transmit a rotational force.

As described above, a diameter of the boss portion 125*b* may be reduced to increase an amount of water or wash water introduced from the inlet port 113. Furthermore, a diameter of the boss portion 125*b* may be reduced to obtain an effect of reducing noise generated when water or wash water introduced from the inlet port 113 collides with an outer surface of the boss portion 125*b*.

In addition, a diameter of the boss portion may be reduced to reduce a weight of the impeller, thereby reducing noise generated when rotating the impeller, and increasing a driving efficiency of the motor.

Moreover, referring to FIG. 5A, a first surface (S1) formed by one end of the inlet port 113 may be formed to be closer to the flange portion 125*c* than a third surface (S3) formed by one end of the blade portion 125*b* on the side of the drain pump chamber 410.

The inlet port 113 disposed between the water flow portion 420 and the drain pump chamber 410 of the drain pump for a laundry treating apparatus according to the present disclosure may be formed to protrude toward the water flow portion 420 for water or wash water introduced into the water flow portion 420 not to flow again into the water flow portion 420.

Moreover, a length of the inlet port 113 protruded toward the water flow portion 420 may be formed to be less than a predetermined length not to cause a cavitation phenomenon at the inlet port 113 due to an excessively high pressure between the water flow portion 420 and the drain pump chamber 410.

Figure 5D:
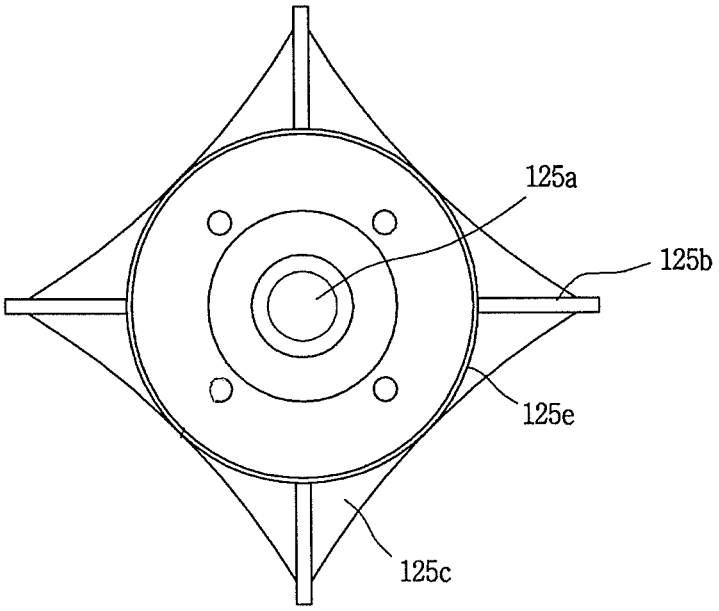
FIG. 5D is a plan view illustrating another embodiment of an impeller provided in the drain pump of the present disclosure.
Figure 5E:
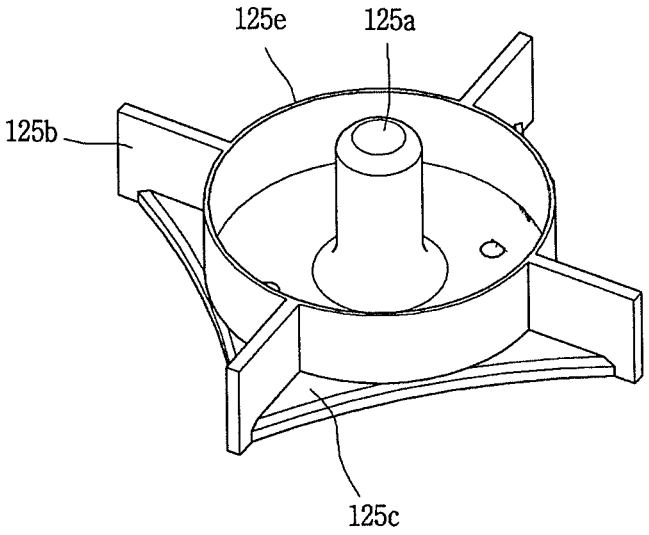
FIG. 5E is a front view illustrating another embodiment of an impeller provided in the drain pump of the present disclosure.

Meanwhile, referring to FIGS. 5D and 5E, another embodiment of the impeller 125 is illustrated.

Referring to FIGS. 5D and 5E, the impeller 125 may include a plurality of blade portions 125*b* and a frame 125*e* formed on one surface of the flange portion 125*c* to interconnect the plurality of blade portions 125*b*. For example, the frame 125*e* may be formed in a circular shape. In another example, a height of the frame 125*e* may correspond to that of the blade portion 125*b*.

As illustrated in FIG. 5E, the blade portion 125*b* may be positioned at an outer side of the frame 125*e*. In other words, the blade portion 125*b* may be positioned at an outer side of the frame 125*e* with respect to the center of the impeller 125.

In other words, the impeller 125 according to the present disclosure may include the integral frame 125*e* connected to the plurality of radially disposed blade portions 125*b*, thereby preventing foreign substances from being wrapped around the blade.

Furthermore, the frame 125*e* may guide water or wash water flowing out of the inlet port 113 protruded toward the water flow portion 420 back to an outer surface of the inlet port 113, thereby preventing a backward flow of the drain pump.

Figure 6:
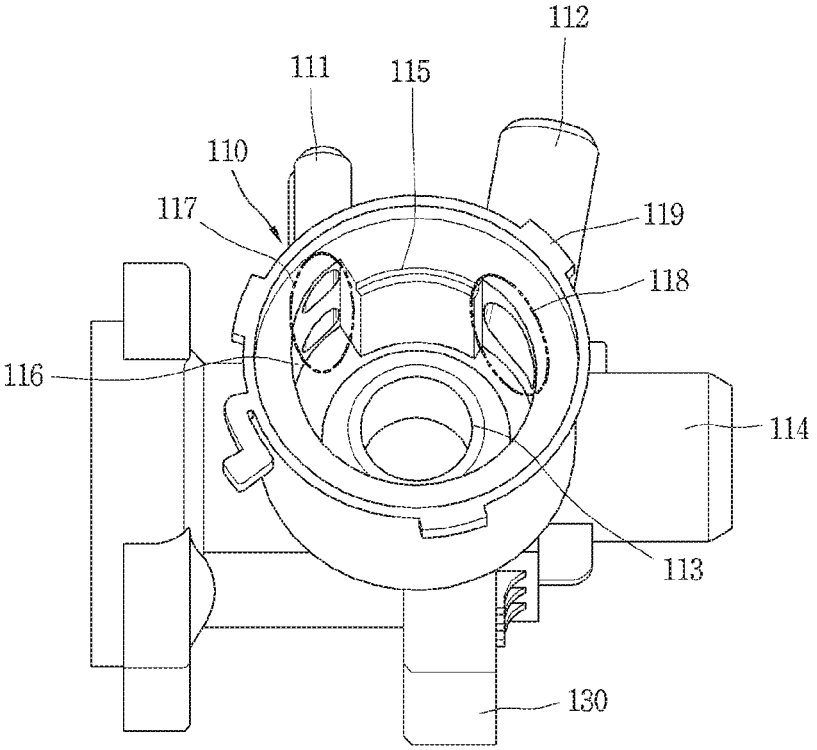
FIG. 6 is a perspective view illustrating a drain pump according to an embodiment of the present disclosure.
Figure 7:
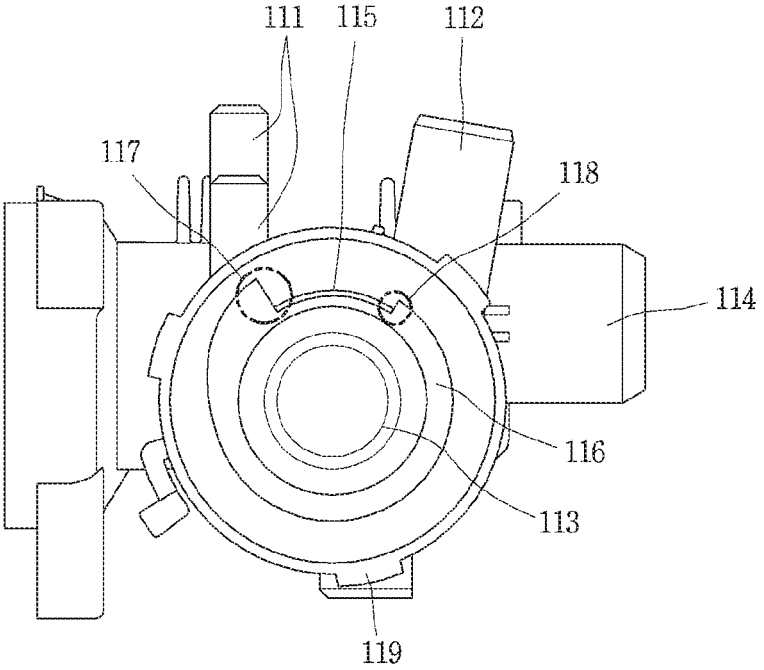
FIG. 7 is a front view in which the drain pump in FIG. 6 is seen from the front.

FIG. 6 is a perspective view illustrating the housing 110 of the drain pump according to an embodiment of the present disclosure, and FIG. 7 is a view in which the housing 110 of the drain pump 100 in FIG. 6 is seen from the front.

The housing 110 is formed in a cylindrical shape and the inlet port 113 communicating with the drain pump chamber 19 is formed at one end thereof. Furthermore, protrusions 119 are formed at regular intervals at the other end thereof to couple to the impeller case 126.

The circulation port 111 and the drain port 112 are respectively formed on an outer circumferential surface of the housing 110. A rib 115 formed to protrude toward an inside of the housing 110 is positioned on an inner circumferential surface of the housing 110.

The rib 115 is made to protrude from one end of an inner circumferential surface thereof toward an inside of the housing 110, and formed along the inner circumferential surface in the length direction of the housing 110.

The rib 115 serves to limit the formation of a vortex generated by the flow of water or wash water inside the housing 110. Water or wash water accommodated into the housing 110 flows by the rotation of the impeller 125 to generate a vortex, which is a swirling flow of the fluid.

The rib 115 may reduce the formation of a vortex generated during the rotation of the impeller 125, thereby preventing water or wash water from flowing backward to the drain port 112 in the circulation process, and preventing water or wash water from flowing backward to the circulation port 111 in the drainage process. In particular, when water or wash water flows backward into the drain port 112 in the circulation process, it may cause a problem in which an amount of water circulated to the tub becomes small. In other words, the rib 115 serves to efficiently perform the movement of water or wash water to the circulation port 111 or the drain port 112.

The water flow portion 116 through which water or wash water flows is formed on an inner circumferential surface of the housing 110, and a first groove portion 117 and a second groove portion 118 formed to be recessed toward the circulation port 111 and the drain port 112 are formed on the water flow portion 116.

The rib 115 has a shape protruded from an inner circumferential surface of the housing 110 between the first groove portion 117 and the second groove portion 118 toward an inside of the housing 110.

The rib 115 is spaced apart from the impeller 125 by a predetermined distance so as to enable the rotation of the impeller 125 mounted on the housing 110. A separated distance between the ribs 115 and the impeller 125 may be arbitrarily determined by the user depending on a thickness of the ribs 115 and a size of the impeller 125.

The rib 115 is protruded to have a predetermined thickness so as to be spaced apart from the impeller 125 by a predetermined distance. The rib 115 may have a curved surface portion corresponding to an outer shape of the impeller 125. The curved surface portion has a curved shape having a predetermined curvature so as to correspond to an outer shape of the circular impeller 125.

The rib 115 may be formed to have a greater thickness toward one end thereof. A thickness of the rib 115 may be increased toward the first groove portion 117, and the thickness of the rib 115 may be decreased toward the second groove portion 118. In other words, the ribs 115 may be formed so as to have a smaller thickness from the side of the first groove portion 117 toward the side of the second groove portion 118. In other words, a thickness of one end protruded toward the first groove portion 117 is larger than that of the other end protruded toward the second groove portion 118.

The water flow portion 116 configured to guide water or wash water accommodated in the housing 110 to flow through the rotation of the impeller 125 is formed on an inner circumferential surface of the housing 110.

The water flow portion 116 has the first groove portion 117 and the second groove portion 118.

The first groove portion 117 is recessed toward a position communicating with the circulation port 111 to perform the role of guiding the movement of water or wash water accommodated in the housing 110. The second groove portion 118 is recessed toward a position communicating with the drain port 112 to perform the role of guiding the movement of a fluid accommodated in the housing 110.

The first groove portion 117 and the second groove portion 118 may be recessed in different shapes. The first groove portion 117 is formed to have a larger recessed area than the second groove portion 118 such that water or wash water within the housing 110 efficiently flows into the circulation port 111. A recessed area of the first groove portion 117 may be larger than that of the second groove portion 118 to increase an amount of pumped water, thereby reducing water or wash water flowing backward into the drain port 112 in the circulation process.

As illustrated in FIG. 7, since a recessed area of the first groove portion 117 is larger than that of the second groove portion 118, when the water flow portion 116 is seen from the front, the water flow portion 116 has an asymmetrical shape.

Figure 8A:
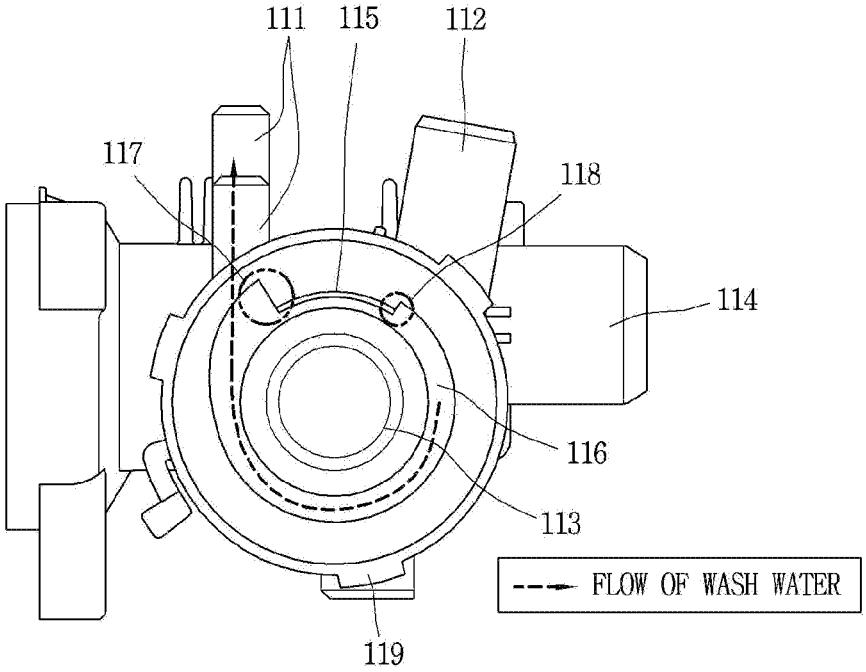
FIG. 8A is a view illustrating a flow of water or wash water when the impeller rotates in a clockwise direction.
Figure 8B:
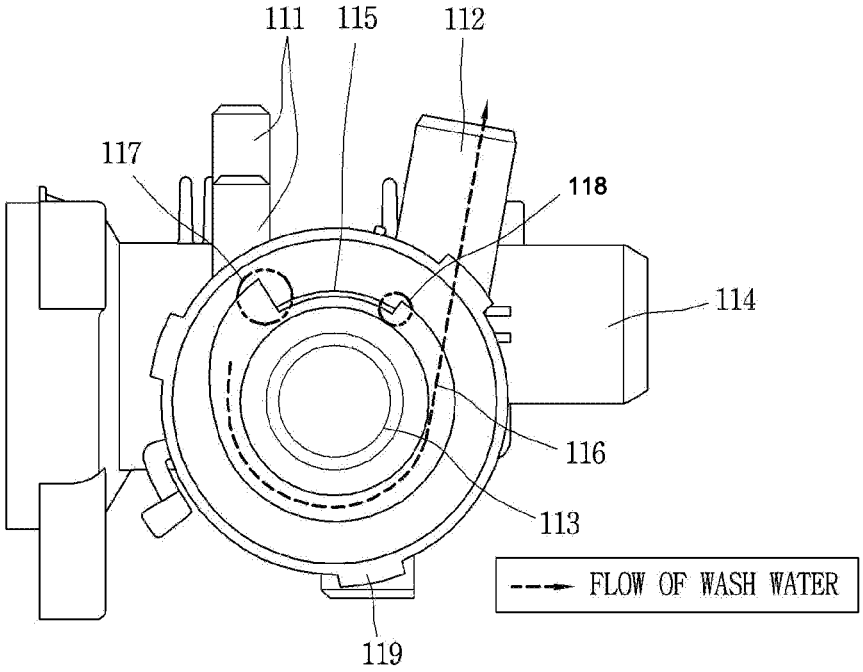
FIG. 8B is a view illustrating a flow of water or wash water when the impeller rotates in a counterclockwise direction.

FIGS. 8A and 8B are views illustrating a flow of water or wash water due to the rotation of the impeller 125, in which water or wash water moves toward the drain port 112 or the circulation port 111 by the rotation of the impeller 125.

In the present disclosure, a motor for implementing the rotation of the impeller 125 may be formed with a BLDC motor, thereby allowing the controller to control the speed and direction. By rotating the BLDC motor in a clockwise or counterclockwise direction, the impeller 125 may rotate in a clockwise or counterclockwise direction to form a flow of water or wash water accommodated in the housing 110.

FIG. 8A illustrates a state in which water or wash water accommodated in the housing 110 is discharged toward the circulation port 111. When the impeller 125 rotates in a clockwise direction, water or wash water flows in a clockwise direction along the water flow portion 116 by the impeller 125, and thus moves in a direction toward the circulation port 111.

At this time, water or wash water flowing in a clockwise direction moves toward the first groove portion 117 along the water flow portion 116, and thus the water or wash water is guided to the circulation port 111 by the rib 115 protruded from one end of an inner circumferential surface of the housing 110 toward the inside.

The rib 115 has a shape protruded toward the inside, and thus performs the role of moving water or wash water moved to the first groove portion 117 toward the circulation port 111, and the role of preventing the water or wash water from flowing backward toward the drain port 112 due to the rotation of the impeller 125. Water or wash water flowing through the circulation port 111 moves to the tub 18 through the connected hose.

FIG. 8B illustrates a configuration in which water or wash water flows in a counterclockwise direction along the water flow portion 116 by the impeller 125 when the impeller 125 rotates in a counterclockwise direction.

When the impeller 125 rotates in a counterclockwise direction, water or wash water accommodated in the housing 110 flows in a counterclockwise direction. At this time, water or wash water flowing in a counterclockwise direction moves toward the second groove portion 118 along the water flow portion 116, and thus the water or wash water is guided to the drain port 112 by the rib 115 protruded from one end of an inner circumferential surface of the housing 110 toward the inside.

The rib 115 has a shape protruded toward the inside, and thus performs the role of moving water or wash water moving to the first groove portion 118 toward the drain port 112, and preventing the water or wash water from flowing backward toward the circulation port 112.

Figure 9:
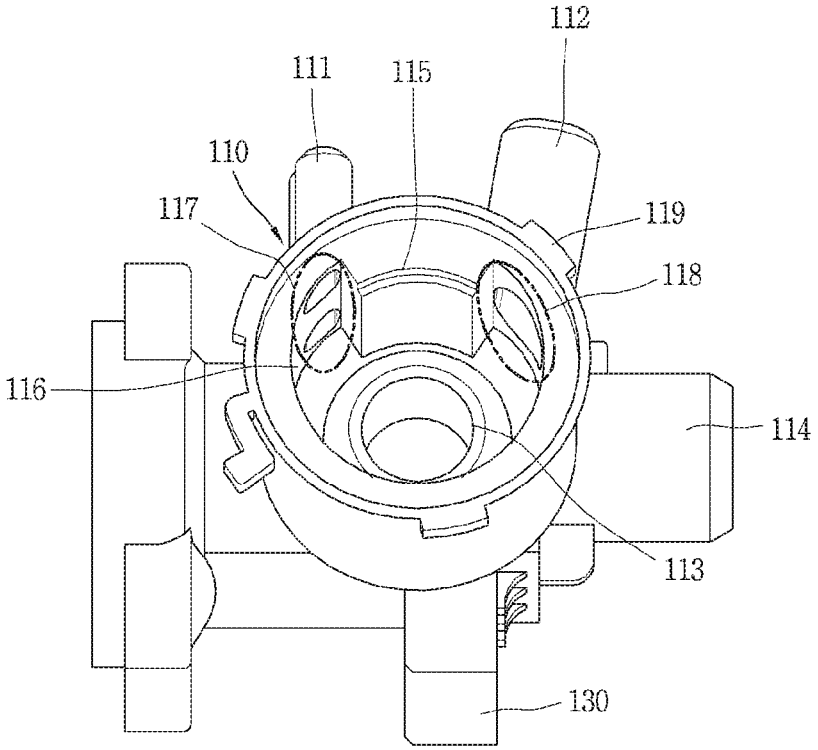
FIG. 9 is a perspective view illustrating a drain pump according to another embodiment of the present disclosure.
Figure 10:
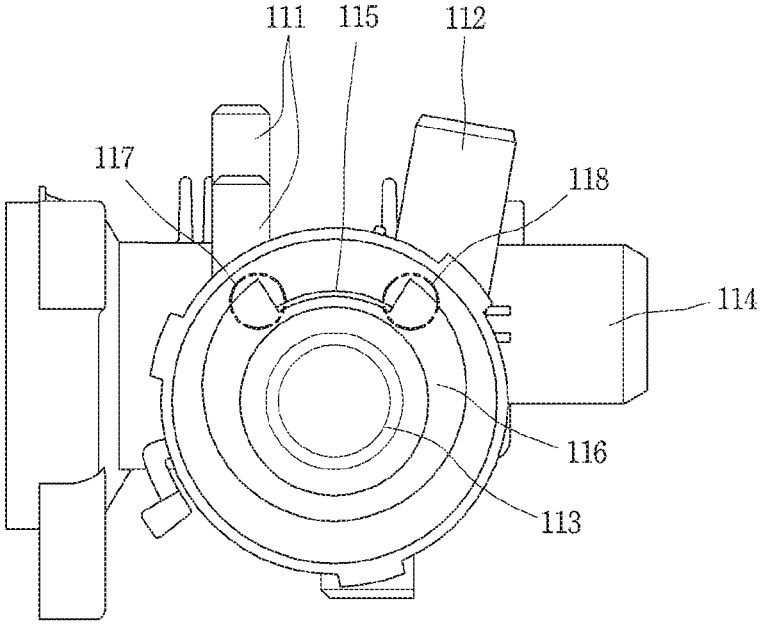
FIG. 10 is a front view illustrating a drain pump in FIG. 9.

FIGS. 9 and 10 are views illustrating a drain pump according to another embodiment of the present disclosure. FIG. 9 is a front view illustrating the housing 110 of the drain pump, and FIG. 10 is a front view in which the housing 110 of the drain pump 100 in FIG. 9 is seen from the front.

The drain pump illustrated in FIGS. 9 and 10 has the same function as the drain pump 100 described above. However, since the shape of the drain pump 100 described with reference to FIGS. 6 and 7 is somewhat different from that of the drain pump 100, it will be mainly described.

Referring to FIGS. 9 and 10, the housing 110 is formed in a cylindrical shape, and the inlet port 113 communicating with the drain pump chamber 19 is formed at one end thereof, and the protrusion protrusions 119 are formed at regular intervals on an outer circumferential surface of the other end thereof so as to be coupled to the impeller case 126. Furthermore, the circulation port 111 and the drain port 112 are respectively formed on an outer circumferential surface of the housing 110 so as to face outward.

The rib 115 formed to protrude toward an inside of the housing 110 is positioned on an inner circumferential surface of the housing 110. The rib 115 is made to protrude from one end of an inner circumferential surface thereof toward an inside of the housing 110, and formed on an inner circumferential surface along a length direction of the housing 110.

The water flow portion 116 through which water or wash water flows is formed on an inner circumferential surface of the housing 110, and a first groove portion 117 and a second groove portion 118 recessed toward the circulation port 111 and the drain port 112 are formed on the water flow portion 116. The rib 115 is configured to protrude from an inner circumferential surface of the housing 110 between the first groove portion 117 and the second groove portion 118 toward an inside of the housing 110.

As illustrated in FIG. 9, the first groove portion 117 and the second groove portion 118 are shown to be recessed in the same shape, unlike the shape of the drain pump housing 110 in FIGS. 6 and 7.

As shown in FIG. 9, the first groove portion 117 and the second groove portion 118 are recessed in the same shape, and the rib 115 is protruded in an inward direction from an inner circumferential surface of the housing 110 between the first groove portion 117 and the second groove portion 118, and thus water or wash water flowing in the housing 110 may be moved toward the circulation port 111 or the drain port 112.

The rib 115 may have the same thickness between the first groove portion 117 and the second groove portion 118, and may be protruded toward an inside of the housing 110. The rib 115 is protruded to have a predetermined thickness so as to be spaced apart from the impeller 125 by a predetermined distance. The rib 115 may have a curved surface portion to correspond to an outer shape of the impeller 125. The rib 115 serves to limit the formation of a vortex generated by the flow of water or wash water inside the housing 110, and it is the same as described above.

As illustrated in FIG. 10, when the water flow portion 116 is seen from the front, the recessed areas of the first groove portion 117 and the second groove portion 118 are the same, and thus right and left upper portions of the water flow portion 116 are recessed in the same shape to have a symmetrical shape in the left and right.

Figure 11:
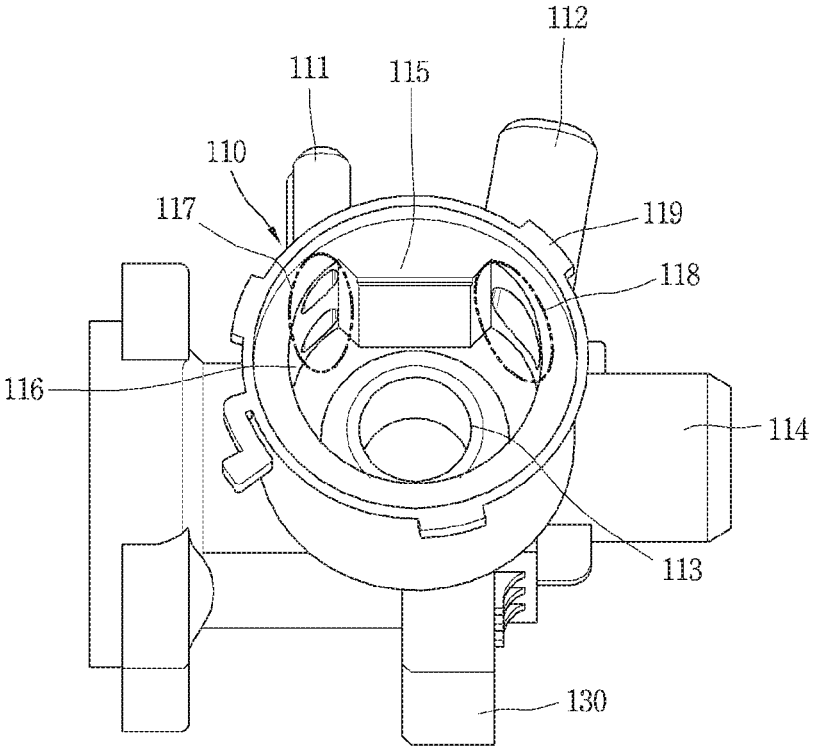
FIG. 11 is a perspective view illustrating a drain pump according to another embodiment of the present disclosure.
Figure 12:
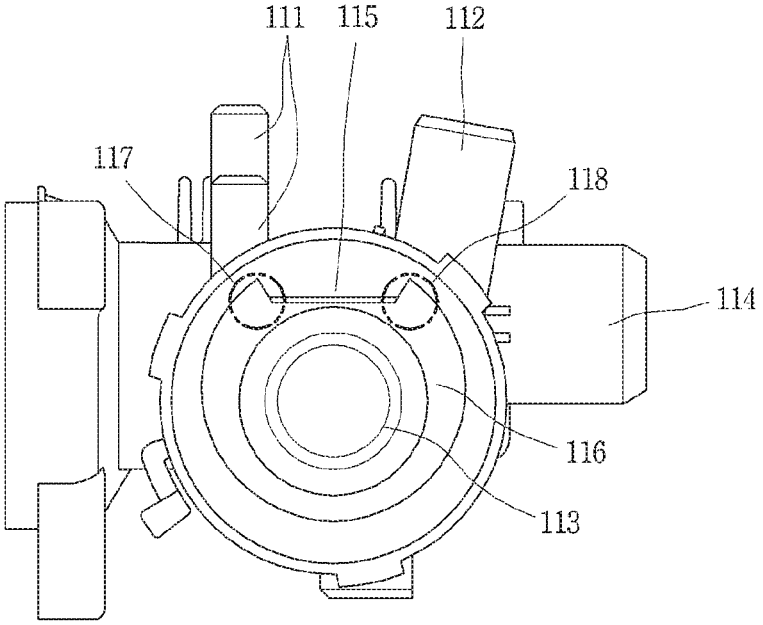
FIG. 12 is a front view illustrating the drain pump in FIG. 10.

FIGS. 11 and 12 are views illustrating the drain pump according to still another embodiment of the present disclosure.

As illustrated in FIG. 11, an outer circumferential surface of the rib 115 formed to protrude from an inner circumferential surface of the housing 110 may be deformed into a different shape other than a curved surface to correspond to the shape of the impeller 125.

The rib 115 is protruded toward an inside of the housing 110, and the rib 115 may have a flat outer circumferential surface other than a curved surface at an outer side thereof. However, the rib 115 should be spaced apart from the impeller 125 by a predetermined distance to perform the rotation of the impeller 125 within the housing 110. The rib 115 is protruded to have a predetermined thickness so as to be spaced apart from the impeller 125 by a predetermined distance.

Furthermore, as described above, water or wash water accommodated in the housing 110 may flow by the impeller 125 rotating in a clockwise or counterclockwise direction, thereby blocking the water or wash water from flowing to the drain port 112 in the circulation process, and preventing the water or wash water from moving to the circulation port 111 in the drainage process due to the rib 115 protruded toward an inside of the housing 110.

When FIG. 12 is seen from the front, it is seen that the rib 115 protruded from an inner circumferential surface of the housing 110 toward an inside of the housing 110 has an uneven outer surface rather than a curved surface. In addition, the first groove portion 117 and the second groove portion 118 are recessed in the same area.

When the impeller 125 rotates in a clockwise direction by the rib 115, the first groove portion 117 and the second groove portion 118, water or wash water may flow toward the first groove portion 117, thereby preventing the water or wash water from flowing backward to the drain port 112 through the second groove portion 118 by the rib 115 protruded toward an inside of the housing 110. When the impeller 125 rotates in a counterclockwise direction in the same manner, water or wash water may flow toward the second groove portion 118, and thus the rib 115 may prevent water or wash water from moving toward the first groove portion 117 to block a backflow of the water or wash water into the circulation port 111. For the rotation of the impeller 125, the rotational direction and rotational speed of the BLDC motor may be controlled by the controller as described above, and thus rotated according to the drainage process and the circulation process.

A laundry treating apparatus having the foregoing drain pump for a laundry treating apparatus will not be limited to the configurations and methods according to the above-described embodiments, and all or part of each embodiment may be selectively combined and configured to make various modifications thereto.

An object of the present disclosure is to propose a structure of a drain pump capable of performing both the roles of a drain pump and a circulation pump.

Another object of the present disclosure is to propose a structure capable of allowing water or wash water flowing into a drain pump to flow in a specific direction so as to perform a drainage process or a circulation process.

Still another object of the present disclosure is to propose a structure capable of rotating water or wash water in one direction within a drain pump to move water or wash water toward a drain port or rotating water or wash water in another direction to move water or wash water toward a circulation port.

Yet still another object of the present disclosure is to propose a drain pump capable of preventing water or wash water from flowing backward to a drain port during the circulation process of water or wash water, and efficiently moving water or wash water toward a circulation port to increase an amount of pumped water.

Still yet another object of the present disclosure is to propose a drain pump capable of preventing water or wash water from flowing backward to a circulation port during the drainage process of water or wash water, and efficiently moving water or wash water toward a drain port to increase an amount of pumped water.

Yet still another object of the present disclosure is to propose a structure of a drain pump capable of preventing noise caused by cavitation within a drain pump while preventing water or wash water from flowing backward.

Still yet another object of the present disclosure is to propose a structure of a drain pump capable of preventing foreign substances from being entangled around the impeller when a drainage process or a circulation process is performed in both directions.

In order to accomplish the foregoing tasks of the present disclosure, a drain pump according to an embodiment of the present disclosure may include a housing configured to accommodate water or wash water, a water flow portion provided with an impeller forming the flow of the water or wash water, and formed on an inner circumferential surface of the housing to circulate the accommodated water or wash water to a tub or drain the accommodated water or wash water to the outside, a drain pump chamber formed on an inner circumferential surface of the housing to receive or store the water or wash water before the water or wash water flows into the water flow portion, and an inlet port formed to protrude toward the water flow portion between the water flow portion and the drain pump chamber.

According to an embodiment, a portion of the impeller may be formed to be positioned within the inlet port.

According to an embodiment, the impeller may be formed to face the inlet port.

According to an embodiment, the impeller may include a boss portion coupled to a rotating shaft of a motor providing a driving force for rotating the impeller, a blade portion spaced apart from the boss portion, and a flange portion formed with a plate connecting the boss portion and the blade portion.

According to an embodiment, a diameter of the boss portion may be formed to be smaller than that of the inlet port.

According to an embodiment, a first surface formed by one end of the inlet port may be formed closer to the flange portion than a second surface formed by one end of the boss portion on the drain pump chamber side.

According to an embodiment, the first surface may be formed closer to the flange portion than a third surface formed by one end of the blade portion on the drain pump chamber side.

According to an embodiment, the blade portion may be formed to protrude in a radial direction of the flange portion out of the flange portion.

According to an embodiment, the impeller may include a plurality of blade portions, and a frame formed on one surface of the flange to interconnect the plurality of blade portions.

According to an embodiment, the frame may be formed in a circular shape.

According to an embodiment, the drain pump may include a circulation port and a drain port formed to protrude from the housing, and communicated with the housing to form a moving path of the water or wash water, and positioned to be spaced apart from each other, wherein the housing includes a rib formed between the circulation port and the drain port, and the rib guides the movement of the water or wash water to the circulation port or the drain port by the rotation of the impeller in one direction. As a result, the flow of the water or wash water due to the rotation of the impeller may be formed to prevent an amount of pumped water from being reduced due to the water or wash water flowing backward while flowing in one direction.

According to an example of the present disclosure, a water flow portion configured to allow the accommodated water or wash water to flow through rotation of the impeller may be formed on an inner circumferential surface of the housing, wherein the water includes a first groove portion recessed toward a position communicating with the circulation port to guide the movement of liquid accommodated into the housing; and a second groove portion recessed toward a position communicating with the drain port to guide the movement of liquid accommodated into the housing.

Here, the first groove portion and the second groove portion may be recessed in different shapes.

In addition, the first groove portion may have a larger recessed area than that of the second groove portion.

Here, a thickness of the rib protruded toward the inside may be reduced as it goes from the first groove portion to the second groove portion.

According to an example associated with the present disclosure, the rib may be spaced apart from the impeller by a predetermined distance to allow the rotation of the impeller.

Here, the rib may have a curved surface portion on an outer circumferential surface thereof to have a shape corresponding to an outer shape of the impeller.

According to an example of the present disclosure, protrusion portions protruded outward from an outer circumferential surface of the housing may be formed at predetermined intervals on the housing so as to be fitted and fixed to protrusion accommodation portions of an impeller case supporting the impeller.

According to an example of the present disclosure, the motor may be a BLDC motor capable of controlling a driving speed and a driving direction.

According to an example of the present disclosure, the drain pump may further include a controller for transmitting and controlling a signal to the motor such that the impeller has a predetermined rotational direction and speed.

According to the present disclosure having the foregoing configuration, it may be possible to realize a drain pump capable of performing both the drain pump and the circulation pump using one motor and one impeller, thereby preventing an installation space inside the laundry treating apparatus from being limited. Furthermore, it may be possible to save costs in comparison with a separate implementation of the drain pump and the circulation pump.

In addition, the present disclosure may switch a rotational direction of the impeller to rotate water or wash water flowing into the drain pump in a clockwise or counterclockwise direction, thereby allowing the execution of a drainage process or circulation process.

Furthermore, the present disclosure may rotate water or wash water in one direction within the drain pump to move the water or wash water toward the drain port or rotate water or wash water in another direction to move the water or wash water toward the circulation port, thereby allowing the adjustment of the water or wash water.

In addition, the present disclosure may prevent water or wash water from flowing backward to the drain port in the circulation process of water or wash water through a rib formed toward an inside of the housing to efficiently move the water or wash water to the circulation port, thereby increasing the amount of pumped water.

Moreover, the present disclosure may prevent water or wash water from flowing backward to the circulation port in the drainage process of water or wash water due to the rib.

Furthermore, according to the present disclosure, it may be possible to prevent water or wash water from flowing backward from the water flow portion to the drain pump chamber in the drainage process of water or wash water due to an inlet port structure protruded toward the water flow portion.

In addition, the present disclosure may adjust a protruded length of the inlet port to maintain an inflow pressure of water or wash water at an appropriate level, thereby preventing a cavitation phenomenon in the drain pump.

Moreover, the present disclosure may decrease a diameter of the boss portion of the impeller, thereby obtaining an effect of increasing an amount of pumped water or wash water flowing from the inlet port of the drain pump, and reducing noise generated when the water or wash water flowing from the inlet port collides with the impeller.

In addition, a weight of the impeller may be reduced by reducing a diameter of the boss portion, thereby reducing noise generated when rotating the impeller, and increasing a driving efficiency of the motor.

Furthermore, the impeller according to the present disclosure may include an integral frame connected to a plurality of radially arranged blade portions, thereby preventing foreign substances from being entangled around the blades. In addition, an effect of increasing a backflow prevention effect of the drain pump may be obtained by the frame.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drain pump, comprising:

a housing configured to accommodate water;

a first discharge port and a second discharge port to protrude from the housing, and the first discharge port is spaced apart from the second discharge port;

a water flow portion having an impeller, and the water flow portion is provided at an inner surface of the housing to discharge the water through the first discharge port or through the second discharge port;

a drain pump chamber at an inner surface of the housing to receive the water before the water is provided at the water flow portion; and an inlet port between the water flow portion and the drain pump chamber, wherein a portion of the impeller is within the inlet port, wherein a length of the inlet port protruded toward the water flow portion is formed to be less than a predetermined length not to cause a cavitation phenomenon at the inlet port due to a pressure difference between the water flow portion and the drain pump chamber, and wherein the impeller is to guide water or wash water flowing out of the inlet port back to an outer surface of the inlet port.

2. The drain pump of claim 1, wherein the impeller is to face the inlet port.

3. The drain pump of claim 1, wherein the impeller includes:

a boss coupled to a shaft, wherein the shaft is coupled to a motor that provides a driving force for rotating the impeller;

at least one blade spaced from the boss; and a flange connecting the boss and the blade.

4. The drain pump of claim 3, wherein a diameter of the boss is less than a diameter of the inlet port.

5. The drain pump of claim 3, wherein a first line defined by one end of the inlet port is closer to the flange than a second line defined by one end of the boss closer to the drain pump chamber.

6. The drain pump of claim 5, wherein the first line is closer to the flange than a third line defined by one end of the blade closer to the drain pump chamber.

7. The drain pump of claim 3, wherein the blade is to protrude in a radial direction from the flange.

8. The drain pump of claim 3, wherein the impeller includes:

a plurality of blades; and a frame at a surface of the flange to interconnect the plurality of blades.

9. The drain pump of claim 8, wherein the frame has a circular shape.

10. The drain pump of claim 8, wherein the blades are outside of the frame with respect to a center of the impeller.

11. The drain pump of claim 1, wherein a thickness of the inlet port at the drain pump chamber is greater than a thickness of the inlet port at the water flow portion.

12. A drain pump for a laundry treating apparatus, comprising:

a housing configured to accommodate wash water;

a circulation port and a drain port to protrude from the housing, and the circulation port is spaced from the drain port;

a water flow portion having an impeller, and the water flow portion is provided at an inner surface of the housing to discharge the wash water through the circulation port or through the drain port;

a drain pump chamber at an inner surface of the housing to receive the wash water before the wash water flows into the water flow portion; and an inlet port between the water flow portion and the drain pump chamber, wherein a protruded end of the inlet port is surrounded by a first portion of the impeller, and a second portion of the impeller is within the inlet port, wherein a length of the inlet port protruded toward the water flow portion is formed to be less than a predetermined length not to cause a cavitation phenomenon at the inlet port due to a pressure difference between the water flow portion and the drain pump chamber, and wherein the impeller is to guide water or wash water flowing out of the inlet port back to an outer surface of the inlet port.

13. The drain pump of claim 12, wherein the impeller is to face the inlet port.

14. The drain pump of claim 12, wherein the impeller includes:

a boss coupled to a shaft, wherein the shaft is coupled to a motor that rotates the impeller;

at least one blade spaced from the boss; and a flange connecting the boss and the blade.

15. The drain pump of claim 14, wherein a diameter of the boss is less than a diameter of the inlet port.

16. The drain pump of claim 14, wherein a first line defined by one end of the inlet port is closer to the flange than a second line defined by one end of the boss closer to the drain pump chamber.

17. The drain pump of claim 16, wherein the first line is closer to the flange than a third line defined by one end of the blade closer to the drain pump chamber.

18. A drain pump, comprising:

a first discharge port and a second discharge port to provide discharge of wash water;

a water flow component having an impeller to control flow of the wash water, and the water flow component to control discharge of the wash water through the first discharge port or through the second discharge port;

a drain pump chamber to receive the wash water prior to the wash water being provided at the water flow component; and an inlet port between the water flow component and the drain pump chamber, wherein a portion of the impeller is within the inlet port, wherein a first part of the impeller is at a protruded part of the inlet port, and a second part of the impeller is at the inlet port, wherein a length of the inlet port protruded toward the water flow component is formed to be less than a predetermined length not to cause a cavitation phenomenon at the inlet port due to a pressure difference between the water flow component and the drain pump chamber, and wherein the impeller is to guide water or wash water flowing out of the inlet port back to an outer surface of the inlet port.

19. The drain pump of claim 18, wherein the impeller includes:

a boss coupled to a shaft that rotates the impeller;

at least one blade spaced from the boss; and a flange connecting the boss and the blade.

20. The drain pump of claim 18, wherein the impeller includes:

a plurality of blades; and a frame at a surface of a flange to interconnect a plurality of blades.

* * * * *